US008715019B2

(12) United States Patent
Ho

(10) Patent No.: US 8,715,019 B2
(45) Date of Patent: May 6, 2014

(54) CONNECTOR

(75) Inventor: Yi-Tse Ho, Tainan Hsien (TW)

(73) Assignee: Molex Incorporated, Lisle, IL (US)

( * ) Notice: Subject to any disclaimer, the term of this patent is extended or adjusted under 35 U.S.C. 154(b) by 131 days.

(21) Appl. No.: 13/525,512

(22) Filed: Jun. 18, 2012

(65) Prior Publication Data

US 2012/0329333 A1 Dec. 27, 2012

(30) Foreign Application Priority Data

Jun. 16, 2011 (TW) ..... 100210901 U

(51) Int. Cl.
*H01R 12/00* (2006.01)

(52) U.S. Cl.
USPC ..... 439/862; 439/924.1

(58) Field of Classification Search
USPC ..... 439/66, 74, 289, 862, 924.1
See application file for complete search history.

(56) References Cited

U.S. PATENT DOCUMENTS

| | | | | |
|---|---|---|---|---|
| 5,295,844 | A * | 3/1994 | Koshikawa et al. | 439/138 |
| 5,306,163 | A * | 4/1994 | Asakawa | 439/74 |
| 5,413,510 | A * | 5/1995 | Taylor | 439/886 |
| 5,494,463 | A * | 2/1996 | Nishio et al. | 439/181 |
| 5,662,483 | A * | 9/1997 | Park et al. | 439/101 |
| 5,752,841 | A * | 5/1998 | Hori | 439/108 |
| 5,904,597 | A * | 5/1999 | Doi et al. | 439/660 |
| 6,071,151 | A * | 6/2000 | Igarashi | 439/660 |
| 6,287,151 | B1 * | 9/2001 | Matsuzaki et al. | 439/630 |
| 6,340,315 | B1 * | 1/2002 | Chang | 439/660 |
| 6,379,187 | B2 * | 4/2002 | Nishimatsu | 439/607.35 |
| 6,475,010 | B1 * | 11/2002 | Yu | 439/289 |
| 6,524,117 | B1 * | 2/2003 | Murakami et al. | 439/74 |
| 6,565,371 | B1 * | 5/2003 | Watanabe | 439/138 |
| 6,902,412 | B2 * | 6/2005 | Higgins | 439/101 |
| 7,128,602 | B1 * | 10/2006 | Cromwell et al. | 439/540.1 |
| 7,267,583 | B1 * | 9/2007 | Smith et al. | 439/660 |
| 7,530,814 | B2 * | 5/2009 | Ramaswamy et al. | 439/66 |
| 7,661,968 | B1 * | 2/2010 | Duan et al. | 439/135 |
| 7,789,714 | B2 * | 9/2010 | Liu | 439/682 |
| 7,874,847 | B2 * | 1/2011 | Matsui et al. | 439/66 |
| 7,905,734 | B2 * | 3/2011 | Horiuchi et al. | 439/181 |
| 8,531,284 | B2 * | 9/2013 | Liu | 340/455 |
| 2012/0329333 | A1 * | 12/2012 | Ho | 439/660 |

FOREIGN PATENT DOCUMENTS

| | | |
|---|---|---|
| TW | M325649 U | 1/2008 |
| TW | M345393 U | 11/2008 |
| TW | M364298 U | 9/2009 |

* cited by examiner

*Primary Examiner* — Neil Abrams
(74) *Attorney, Agent, or Firm* — Stephen L. Sheldon

(57) ABSTRACT

An electrical connection device comprises a first connector and a second connector which are mated with each other. The first connector comprises a first insulative housing and a first terminal group. Two terminals of the first terminal group are first protruding terminals, and one other terminal of the first terminal group is a first non-protruding terminal. The second connector comprises a second insulative housing and a second terminal group. At least one terminal of the second terminal group is second protruding terminal and two other terminals of the second terminal group are second non-protruding terminals so that the number of the second protruding terminal is less than the number of the first protruding terminals. The second protruding terminal mates with one of the first protruding terminals and one of the first protruding terminals mates with a second non-protruding terminal.

9 Claims, 6 Drawing Sheets

CONNECTOR

RELATED APPLICATIONS

This application claims priority to Taiwanese Application No. 100210901, filed Jun. 16, 2011, which is incorporated herein by reference in its entirety.

TECHNICAL FIELD

The present application relates to an electrical connection device consisting of two connectors which may be mated with each other, and more specifically, to an electrical connection device having three contact sequences when mating connectors are mated with each other.

BACKGROUND ART

Currently, an electrical connection between two circuit boards is generally established by providing electrical connectors respectively on the two circuit boards and mating the two electrical connectors. For example, an electrical connector, which can be mated with a mating connector in an up-down direction or a sidewise direction, is disclosed by TW Utility Model Patent Publication No. M325649.

However, contact portions of terminals of the two electrical connectors contacts at the same time when the two electrical connectors are mated with each other in the up-down direction. It is easy to cause two problems while mating.

If power terminals of the two electrical connectors have been in contact with each other before ground terminals of the two electrical connectors are in contact with each other, it is easy to generate instantaneously high current during a hot plug process, thereby resulting in the electrical connectors damaged and even electronic product connecting to the electrical connectors damaged.

If signal terminals of the two electrical connectors have been in contact with each other before the power terminals of the two electrical connectors are in contact with each other, when the power terminals are mated it is easy for the power connection to interrupt the signals to be disrupted. Taking two electrical connectors for connecting a computer on board to a satellite navigation mobile device in an automobile as an example, when the two electrical connectors are mated, signal terminals firstly are in contact with each other and transmit signal, but the satellite navigation mobile device does not start yet because power terminals are still not in contact with each other, so that transmitted signal is missed.

SUMMARY OF THE INVENTION

Therefore, an object of the present application is to provide an electrical connection device which can ensure ground terminals, power terminals and signal terminals which contact sequentially.

Accordingly, a depicted electrical connection device comprises a first connector and a second connector which are configured to be mated with each other. The first connector comprises: a first insulative housing having a first mating face; and a first terminal group provided in the first insulative housing. The first terminal group consists of a plurality of terminals, and each of the plurality of terminals of the first terminal group has a soldering portion extending out of the first insulative housing and a contact portion positioned at the first mating face, at least two terminals of the plurality of terminals are first protruding terminals, the other terminal(s) of the plurality of terminals is(are) first non-protruding terminal(s), the contact portion of the first protruding terminal protrudes in a direction away from the first insulative housing relative to the contact portion of the first non-protruding terminal. The second connector comprises: a second insulative housing having a second mating face; and a second terminal group corresponding to the first terminal group and provided in the second insulative housing. The second terminal group consists of a plurality of terminals, and each of the plurality of terminals of the second terminal group has a soldering portion extending out of the second insulative housing and a contact portion positioned at the second mating face, at least one terminal of the second terminal group is(are) second protruding terminal(s), the other terminals of the second terminal group are second non-protruding terminals, and the number of the second protruding terminal(s) is less than the number of the first protruding terminals, each the second protruding terminal corresponds to one of the first protruding terminals, the contact portion of the second protruding terminal protrudes in a direction away from the second insulative housing relative to the contact portion of the second non-protruding terminal.

The first connector approaches and is mated with the second connector in a direction having the first mating face and the second mating face face-to-face, while mating, the second protruding terminal(s) is(are) firstly in contact with the corresponding first protruding terminal(s), the other first protruding terminal(s) is(are) subsequently in contact with the corresponding second non-protruding terminal(s), and the first non-protruding terminal(s) then is(are) in contact with the corresponding second non-protruding terminal(s).

According to one embodiment, the contact portion of the first terminal group is a flat-plate shape, and a region of the first insulative housing where the contact portion of the first protruding terminal is provided protrudes out relative to the other regions at the same side of the first mating face; each of the plurality of terminals of the second terminal group further has a resilient arm, and each of the contact portions of the second terminal group is formed by bending a distal end of the resilient arm. Preferably, each of the plurality of terminals of the second terminal group further has a fixed portion fixedly provided to the second insulative housing and connecting the resilient arm and the soldering portion, the resilient arm extends from the fixed portion as a U-shaped shape. Preferably, the second insulative housing is provided with flanges respectively at two sides thereof in a lengthwise direction at the second mating face so as to define a mating space for receiving the first connector.

According to another embodiment, the contact portion of the second terminal group is a flat-plate shape, and a region of the second insulative housing where the contact portion of the second protruding terminal is provided protrudes out relative to the other regions at the same side of the second mating face; each of the plurality of terminals of the first terminal group further has a resilient arm, and each of the contact portions of the first terminal group is formed by bending a distal end of the resilient arm. Preferably, each of the plurality of terminals of the first terminal group further has a fixed portion fixedly provided to the first insulative housing and connecting the resilient arm and the soldering portion; the resilient arm extends from the fixed portion as a U-shaped shape.

Preferably, the first insulative housing is provided with flanges respectively at two sides thereof in a lengthwise direction at the first mating face so as to define a mating space for receiving the second connector. Furthermore, the first insulative housing further has a plurality of limiting posts with different shapes provided at an opposite side of the first mating face; the second insulative housing further has a plurality of limiting posts with different shapes provided at an opposite side of the second mating face.

DETAILED DESCRIPTION OF THE PREFERRED EMBODIMENTS

Figure 1:
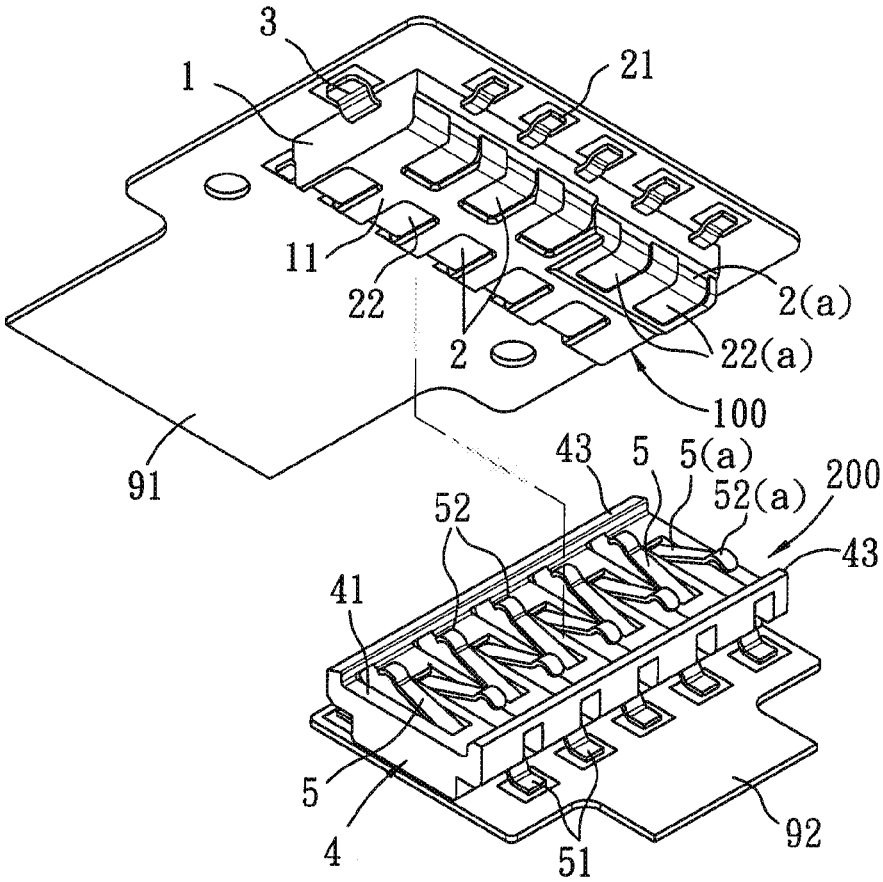
FIG. 1 is a perspective view illustrating an electrical connection device of a first preferred embodiment of the present application.
Figure 2:
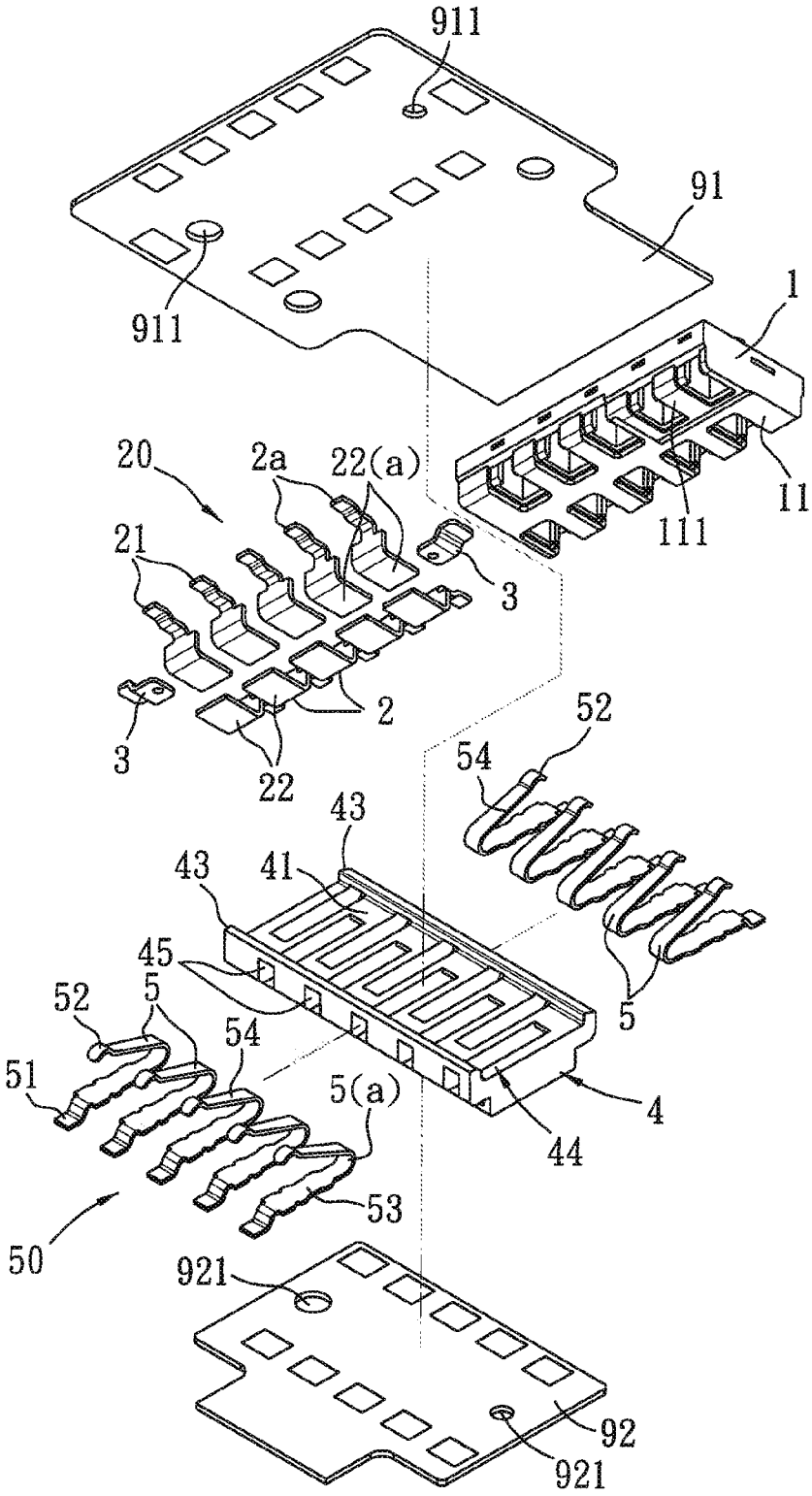
FIG. 2 is an exploded perspective view illustrating the electrical connection device of the first preferred embodiment.
Figure 3:
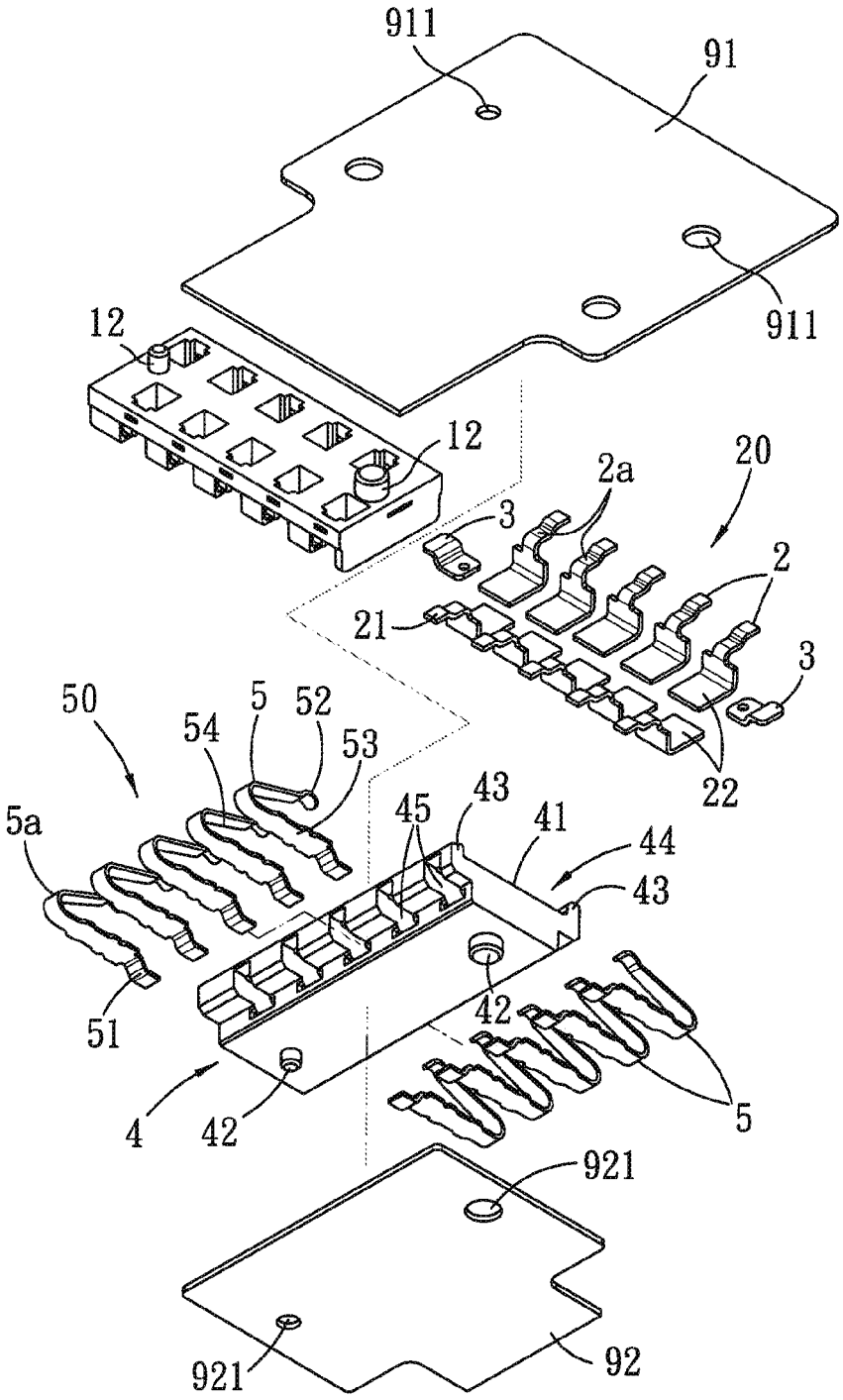
FIG. 3 is a view of FIG. 2 viewed from another view angle.
Figure 4:
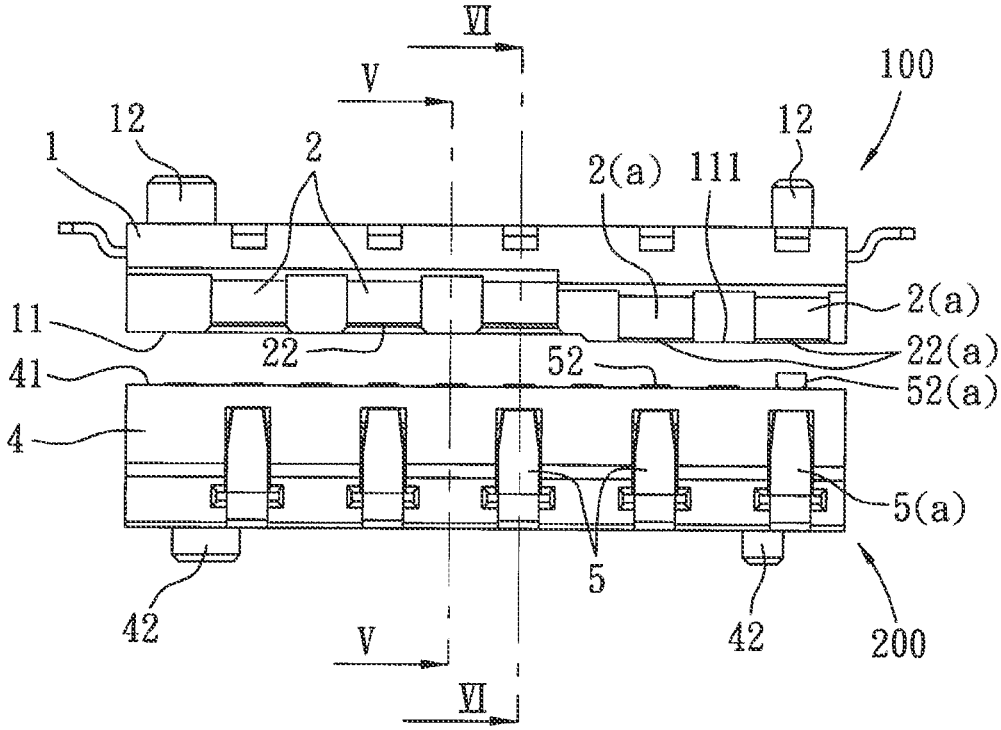
FIG. 4 is a front view illustrating the first preferred embodiment.

The foregoing and other technical contents, features and effects of the present application will be apparent through the following detailed description for two preferred embodiments in combination with the drawings. It should be noted that like reference numerals identify like elements in the following description before the present application will be described in details.

Effects of embodiments depicted herein can include the following. While the first connector and the second connector of the electrical connection device of the present application are mated with each other, connections for the terminals are performed in three stages. The contacts in the three stages can be respectively applicable to a connection between the ground terminals, a connection between the power terminals, and a connection between the signal terminals, so that it can be ensured that firstly grounding, secondly turn on power, and finally transmitting signal are performed sequentially while the first connector and the second connector are mated, instantaneously high current can be prevented from generating during a hot plug process, and transmitted signal can be prevented from being missed. Therefore, the electrical connection device of the present application can solve the existing problem that grounding, transmitting power and signal transmission are not performed sequentially when connectors in prior art are mated.

Furthermore, by providing two different heights for the contact portions of the terminals of the first connector and two different heights for the contact portions of the terminals of the second connector instead of providing three different heights for contact portions of terminals of the same connector, contacts in three stages are generated. In this way, this can prevent an entire height of a single connector from being too large.

Referring to FIGS. 1-4, an electrical connection device of a first preferred embodiment of the present application comprises a connector 100 and a connector 200 which are mated with each other, the connector 100 and the connector 200 may be provided on two flexible printed circuits (FPC) 91, 92, respectively.

The connector 100 comprises an insulative housing 1, a terminal group 20, and two fixed members 3. The insulative housing 1 has a mating face 11 and two limiting posts 12 with different shapes provided at an opposite side of the mating face 11. Two through-holes 911 having shapes respectively corresponding to the limiting posts 12 are provided in the circuit board 91, so as to respectively provide through and fix the limiting posts 12. The two fixed members 3 are provided respectively at two opposite short sides the insulative housing 1 so as to be soldered on the circuit board 91.

Figure 5:
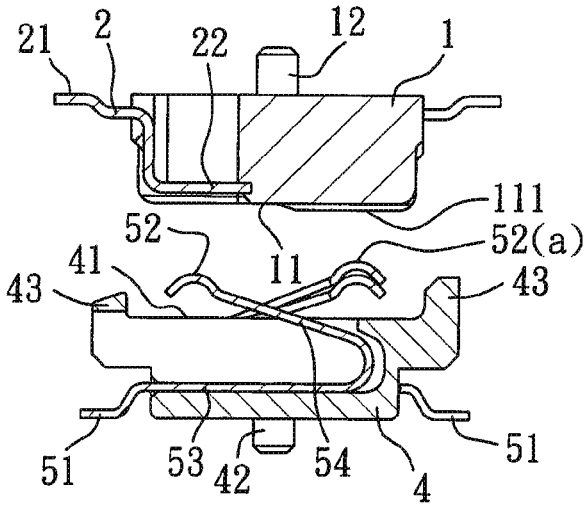
FIG. 5 is a cross sectional view taken along a V-V straight line of FIG. 4.
Figure 6:
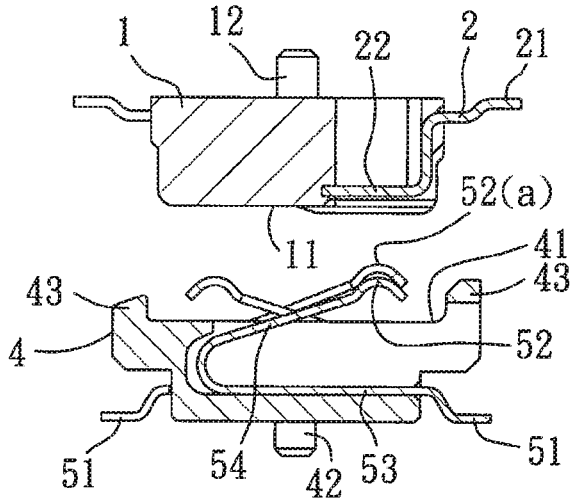
FIG. 6 is a cross sectional view taken along a VI-VI straight line of FIG. 4.
Figure 7:
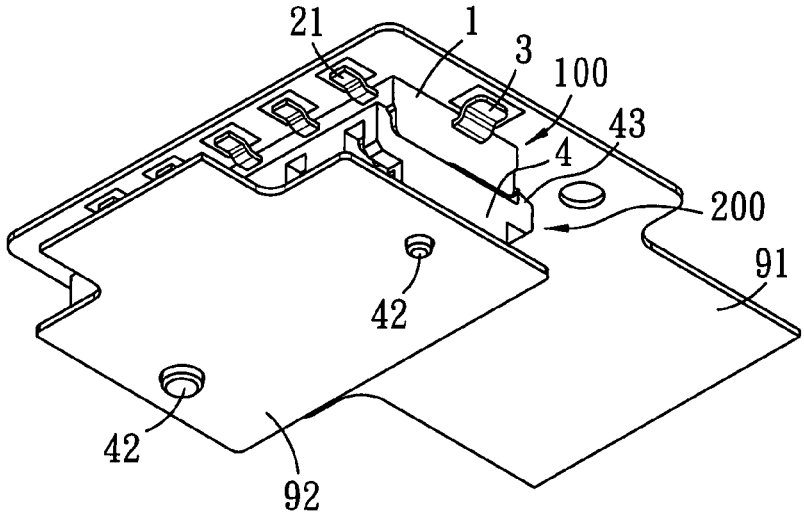
FIG. 7 is a perspective view illustrating a mating relationship between two connectors of the first preferred embodiment.

The terminal group 20 is provided in the insulative housing 1 and consists of a plurality of terminals 2, 2(*a*). And each of the terminals 2, 2(*a*) has a soldering portion 21 extending out of the insulative housing 1 and a contact portion 22, 22(*a*) positioned at the mating face 11. the two terminals of the terminal group 20 are protruding terminals 2(*a*), the other terminal(s) of the terminal group 20 is (are) non-protruding terminal(s) 2, the contact portion 22(*a*) of the protruding terminal 2(*a*) protrudes in a direction away from the insulative housing 1 relative to the contact portion 22 of the non-protruding terminal 2. In the first preferred embodiment, the contact portion 22, 22(*a*) of the terminal group 20 is a flat-plate shape, and a region 111 of the insulative housing 1 where the contact portion 22(*a*) of the protruding terminal 2(*a*) is provided protrudes out relative to the other regions at the same side of the mating face 11 (Referring to FIG. 4, FIG. 5, and FIG. 6), so that the contact portion 22(*a*) of the protruding terminal 2(*a*) protrudes in a direction away from the insulative housing 1 (relatively close to the connector 200) relative to the contact portion 22 of the non-protruding terminal 2. The number of the protruding terminals 2(*a*) may also be three or more as desired.

Referring to FIGS. 1-4 again, the connector 200 comprises an insulative housing 4 and a terminal group 50. The insulative housing 4 has a mating face 41 and two limiting posts 42 with different shapes provided at an opposite side of the mating face 41, and flanges 43 are provided respectively at two sides in a lengthwise direction at the mating face 41 so as to define a mating space 44 for receiving the connector 100. Two through-holes 921 with shapes corresponding to the limiting posts 42 are provided in the circuit board 92 so as to respectively provide through and fix the limiting posts 42.

The terminal group 50 corresponds to the terminal group 20, is provided in the insulative housing 4, and consists of a plurality of terminals 5, 5(*a*); and each of the terminals 5, 5(*a*) of the terminal group 50 has a soldering portion 51 extending out of the insulative housing 4, a contact portion 52, 52(*a*) positioned at the mating face 41, a fixed portion 53 fixedly provided to the insulative housing 4, and a resilient arm 54. The fixed portion 53 connects the resilient arm 54 and the soldering portion 51; the resilient arm 54 extends from the fixed portion 53 as a U-shaped shape so as to increase resilience; and the contact portion 52, 52(*a*) is formed by bending a distal end of the resilient arm 54. One terminal of the terminal group 50 is a protruding terminal 5(*a*), the other terminals of the terminal group 50 are non-protruding terminals 5. In the first preferred embodiment, although the number of the protruding terminal 5(*a*) is one, the number of the protruding terminal 5(*a*) may also be adjusted to two or more as desired, as long as the number of the protruding terminal(s) 5(*a*) is less than the number of the protruding terminals 2(*a*), so that the protruding terminal(s) 5(*a*) can correspond to the protruding terminal(s) 2(*a*), and the other protruding terminal (s) 2(*a*) not corresponding to the protruding terminal(s) 5(*a*)

can correspond to the non-protruding terminal(s) 5. The contact portion 52(*a*) of the protruding terminal 5(*a*) protrudes in a direction away from the insulative housing 4 relative to the contact portion 52 of the non-protruding terminal 5, that is, the contact portion 52(*a*) is relatively close to the mating face 11 of the connector 100.

Referring to FIGS. 4-7, when the connector 100 closes to and is mated with connector 200 in a direction having the mating face 11 and the mating face 41 face-to-face, because the contact portion 22(*a*) of the protruding terminal 2(*a*) of the connector 100 is close to the connector 200 relative to the contact portion 22 of the non-protruding terminal 2, and the contact portion 52(*a*) of the protruding terminal 5(*a*) of the connector 200 is close to the connector 100 relative to the contact portion 52 of the non-protruding terminal 5, while the connector 100 and the connector 200 close oppositely to each other and are mated, the contact portion(s) 52(*a*) of the protruding terminal(s) 5(*a*) is(are) firstly in contact with the contact portion(s) 22(*a*) of the corresponding protruding terminal(s) 2(*a*), the contact portion(s) 22(*a*) of the other protruding terminal(s) 2(*a*) is(are) subsequently in contact with the contact portion(s) 52 of the corresponding non-protruding terminal(s) 5, and the contact portion(s) 22 of the non-protruding terminal(s) 2 is (are) then in contact with the contact portion(s) 52 of the corresponding non-protruding terminal (s) 5.

In other words, the number of the protruding terminals 2(*a*) of the connector 100 is greater than the number of the protruding terminal(s) 5(*a*) of the connector 200, therefore, the protruding terminal(s) 5(*a*) correspond(s) to a part of the protruding terminals 2(*a*), the other part of the protruding terminals 2(*a*) corresponds to the non-protruding terminal(s) 5. In the first preferred embodiment, the number of the protruding terminals 2(*a*) is two, but the number of the protruding terminal 5(*a*) is only one, therefore one of the protruding terminals 2(*a*) correspondingly contacts the protruding terminal 5(*a*), and the other one of the protruding terminals 2(*a*) correspondingly contacts one of the non-protruding terminals 5. While mating, because a distance from the protruding terminal 5(*a*) to one of the protruding terminal 2(*a*) is closest, the protruding terminal 5(*a*) and the one of the protruding terminals 2(*a*) are in contact with each other first. This is because a distance from the other one of the protruding terminals 2(*a*) to the corresponding non-protruding terminal 5 of the connector 200 is shorter than a distance from the non-protruding terminal 2 to the corresponding non-protruding terminal 5 of the connector 200. The other one of the protruding terminals 2(*a*) and the corresponding non-protruding terminal 5 are in contact with each other second. Because a distance from the non-protruding terminal 2 of the connector 100 to the corresponding non-protruding terminal 5 of the connector 200 is farthest, the non-protruding terminals 2 of the connector 100 and the corresponding non-protruding terminals 5 are in contact with each other third.

In other words, because there is a height difference between the contact portion 22(*a*) of the protruding terminal 2(*a*) of the connector 100 and the contact portion 22 of the non-protruding terminal 2 of the connector 100, there is a height difference between the contact portion 52(*a*) of the protruding terminal 5(*a*) of the connector 200 and the contact portion 52 of the non-protruding terminal 5 of the connector 200, and the number of the protruding terminals 2(*a*) of the connector 100 is greater than the number of the protruding terminal(s) 5(*a*) of the connector 200. Therefore, contacts for the terminals can be performed in three stages when the connector 100 and the connector 200 are mated. Therefore, the protruding terminal(s) 5(*a*) and the protruding terminal(s) 2(*a*) correspondingly connected to the protruding terminal(s) 5(*a*) can be configured as ground terminals; the other protruding terminal(s) 2(*a*) and the non-protruding terminal(s) 5 corresponding to the other protruding terminal(s) 2(*a*) can be configured as terminals for transmitting power; the other non-protruding terminal(s) 2 and the non-protruding terminal (s) 5 corresponding to the other non-protruding terminal(s) 2 can be configured as terminals for transmitting signal. This allows the connection to first provide grounding, secondly to provide power, and finally transmitting signal are performed sequentially while the connector 100 is mated with the connector 200. As can be appreciated, instantaneously high current can be prevented from generating during a hot plug process and the loss of transmitted signal can be prevented.

The insulative housing 1 and the terminal group 20 of the foregoing connector 100 are integrated by means of insert molding, the fixed members 3 and the soldering portions 21 of the terminals 2,2(*a*) are soldered on the circuit board 91, and the connector 100 is electrically connected to the circuit board 91 via the soldering portions 21. When the connector 100 is assembled on the circuit board 91, the connector 100 can be positioned by providing the limiting posts 12 through the through-holes 911 with corresponding shapes in the circuit board 91. Moreover, the insulative housing 4 of the connector 200 is provided with terminal grooves 45 corresponding to the terminals of the terminal group 50 in number (Referring to FIG. 2 and FIG. 3), so as to receive corresponding terminals 5, 5(*a*). Each of the terminals 5, 5(*a*) is inserted through each of groove ports of the terminal grooves 45, and the soldering portion 51 of the each of the terminals 5, 5(*a*) are soldered on the circuit board 92 so as to establish an electrical connection between the soldering portion 51 and the circuit board 92.

When the connector 200 is assembled on the circuit board 92, the connector 200 can be positioned by providing the limiting posts 42 through the through-holes 921 with corresponding shapes in the circuit board 92. Furthermore, it is different in shape between the two limiting posts 12 and it is different in shape between the two limiting posts 42. For example, in this embodiment, it is different in thickness between the two limiting posts 12 and it is also different in thickness between the two limiting posts 42, therefore the protruding terminals 2(*a*) of the connector 100 can be positioned relative to the protruding terminal(s) 5(*a*) of the connector 200 so as to make the protruding terminals 2(*a*) of the connector 100 and the protruding terminal(s) 5(*a*) of the connector 200 be positioned in corresponding locations. It is convenient to perform assemble by the limiting posts 12, 42 as a polarizing design.

Figure 8:
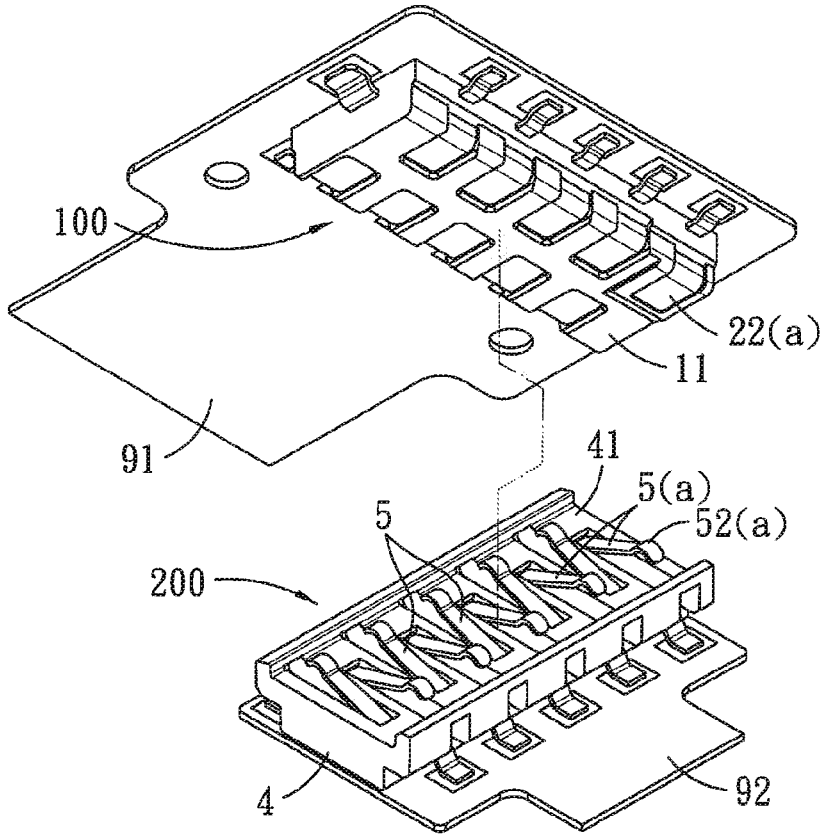
FIG. 8 is a perspective view illustrating an electrical connection device of a second preferred embodiment of the present application.
Figure 9:
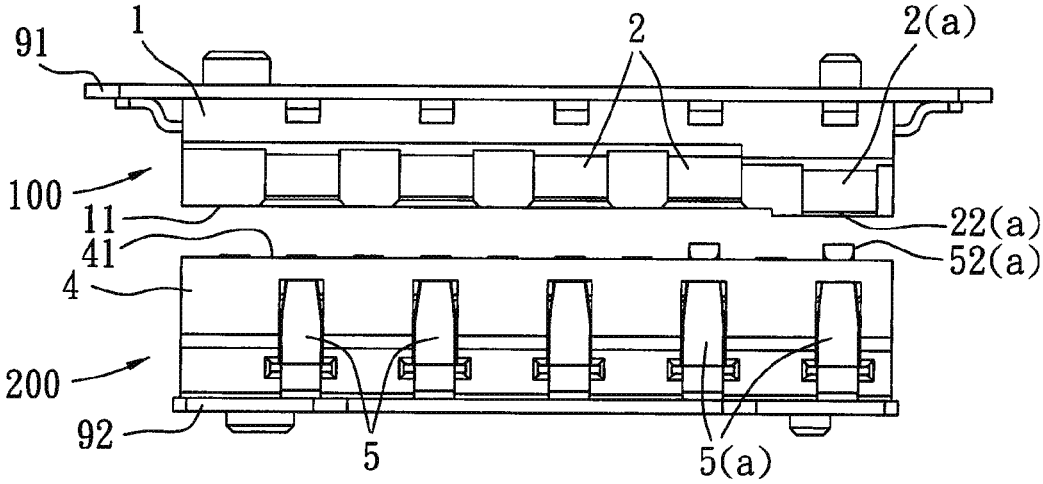
FIG. 9 is a front view illustrating the electrical connection device of the second preferred embodiment.

Referring to FIG. 8 and FIG. 9, an electrical connection device of a second preferred embodiment of the present application is generally the same as the electrical connection device of the first preferred embodiment, however, in the second preferred embodiment, the number of protruding terminal(s) 2(*a*) of the connector 100 is less than the number of protruding terminals 5(*a*) of the connector 200, which is contrary to the first preferred embodiment. Specifically, in the second preferred embodiment, the number of the protruding terminal 2(*a*) of the connector 100 is only one, and the number of the protruding terminals 5(*a*) of the connector 200 is two; one of the protruding terminals 5(*a*) of the connector 200 corresponds to the protruding terminal 2(*a*) of the connector 100, and the other protruding terminal 5(*a*) of the connector 200 corresponds to one of non-protruding terminals 2 of the connector 100. However, in the second preferred embodiment, when the connector 100 is mated with the connector 200, similarly, contacts for the terminals are performed in three-stage time difference, firstly, the protruding terminal 2(*a*) of the connector 100 is in contact with one of the protruding terminals 5(*a*) of the connector 200; secondly, the other one of the protruding terminals 5(*a*) of the connector 200 is in contact with the corresponding one of the non-protruding terminals 2 of the connector 100; finally, the other non-protruding terminals 2 of the connector 100 are in contact with the corresponding non-protruding terminals 5 of the connector 200, and consequently, the electrical connection devices of the second preferred embodiment have the same effect as the first preferred embodiment.

In conclusion, while the first connector 100 and the second connector 200 of the electrical connection device of the present application are mated with each other, contacts for the terminals are performed in three different stages (e.g., at three different times). The contacts in the three stages can be respectively applicable to a connection between the ground terminals, a connection between the power terminals, and a connection between the signal terminals, so that it can be ensured that firstly grounding, secondly turn on power, and finally transmitting signal are performed sequentially while the first connector 100 and the second connector 200 are mated, instantaneously high current can be prevented from generating during a hot plug process, and transmitted signal can be prevented from being missed. Moreover, by providing two different heights between contact portions 22, 22(*a*) of the terminals 2, 2(*a*) of the connector 100 and providing two different heights between contact portions 52, 52(*a*) of the terminals 5, 5(*a*) of the connector 200, the contacts in three stages are generated. In comparison with contacts in three stages which are generated by providing terminals with three different heights in a single connector, this can prevent an entire height of a single connector from being too large.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. An electrical connection device, comprising:

a first connector that includes a first insulative housing having a first mating face and a first terminal group provided in the first insulative housing and consisting of a plurality of terminals, and each of the plurality of terminals of the first terminal group having a soldering portion extending out of the first insulative housing and a contact portion positioned at the first mating face, at least two terminals of the plurality of terminals of the first terminal group being first protruding terminals, the other terminals of the plurality of terminals being first non-protruding terminal, the contact portion of the first protruding terminal protruding in a direction away from the first insulative housing relative to the contact portion of the first non-protruding terminal; and a second connector that includes a second insulative housing having a second mating face and a second terminal group corresponding to the first terminal group, provided in the second insulative housing, and consisting of a plurality of terminals, and each of the plurality of terminals of the second terminal group having a soldering portion extending out of the second insulative housing and a contact portion positioned at the second mating face, at least one terminal of the second terminal group being a second protruding terminal, the other terminals of the second terminal group being second non-protruding terminals, and the number of the second protruding terminal being less than the number of the first protruding terminals, each of the second protruding terminal corresponds to one of the first protruding terminals and at least one of the second non-protruding contacts corresponds to one of the first protruding terminals, the contact portion of the second protruding terminal protruding in a direction away from the second insulative housing relative to the contact portion of the second non-protruding terminal, wherein the first connector and second connector are configured so that the at least one second protruding terminal is in contact with the corresponding first protruding terminal, the other of the at least two first protruding terminals is in contact with the corresponding second non-protruding terminal, and the first non-protruding terminal being in contact with the corresponding second non-protruding terminal.

2. The electrical connection device according to claim 1, wherein the contact portion of the first terminal group is a flat-plate shape, and a region of the first insulative housing where the contact portion of the first protruding terminal is provided protrudes out relative to the other regions at the same side of the first mating face; each of the plurality of terminals of the second terminal group further has a resilient arm, and each of the contact portions of the second terminal group is formed by bending a distal end of the resilient arm.

3. The electrical connection device according to claim 2, wherein the second insulative housing is provided with flanges respectively at two sides thereof in a lengthwise direction at the second mating face so as to define a mating space for receiving the first connector.

4. The electrical connection device according to claim 2, wherein each of the plurality of terminals of the second terminal group further has a fixed portion fixedly provided to the second insulative housing and connecting the resilient arm and the soldering portion, the resilient arm extends from the fixed portion as a U-shaped shape.

5. The electrical connection device according to claim 1, wherein the contact portion of the second terminal group is a flat-plate shape, and a region of the second insulative housing where the contact portion of the second protruding terminal is provided protrudes out relative to the other regions at the same side of the second mating face; each of the plurality of terminals of the first terminal group further has a resilient arm, and each of the contact portions of the first terminal group is formed by bending a distal end of the resilient arm.

6. The electrical connection device according to claim 5, wherein the first insulative housing is provided with flanges respectively at two sides thereof in a lengthwise direction at the first mating face so as to define a mating space for receiving the second connector.

7. The electrical connection device according to claim 5, wherein each of the plurality of terminals of the first terminal group further has a fixed portion fixedly provided to the first insulative housing and connecting the resilient arm and the soldering portion; the resilient arm extends from the fixed portion as a U-shaped shape.

8. The electrical connection device according to claim 7, wherein the first insulative housing further has a plurality of limiting posts with different shapes provided at an opposite side of the first mating face; the second insulative housing further has a plurality of limiting posts with different shapes provided at an opposite side of the second mating face.

9. The electrical connection device according to claim 8, further comprising a first circuit board and a second circuit board, the first circuit board being provided with a plurality of through-holes corresponding to and engaging with the plurality of the limiting posts of the first insulative housing, and each of the plurality of the limiting posts of the first insulative housing being provided through corresponding one of the through-holes of the first circuit board; the second circuit board being provided with a plurality of through-holes corresponding to and engaging with the plurality of the limiting posts of the second insulative housing, and each of the plurality of the limiting posts of the second insulative housing being provided through corresponding one of the through-holes of the second circuit board.

* * * * *